US012285088B2

(12) United States Patent
Luo

(10) Patent No.: US 12,285,088 B2
(45) Date of Patent: Apr. 29, 2025

(54) ROD OF AN UMBRELLA

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 172 days.

(21) Appl. No.: 17/933,275

(22) Filed: Sep. 19, 2022

(65) Prior Publication Data

US 2024/0008607 A1 Jan. 11, 2024

(30) Foreign Application Priority Data

Jul. 8, 2022 (CN) ..... 202210815352.7

(51) Int. Cl.
*A45B 19/10* (2006.01)
*A45B 19/06* (2006.01)

(52) U.S. Cl.
CPC ..... *A45B 19/10* (2013.01); *A45B 19/06* (2013.01)

(58) Field of Classification Search
CPC ..... A45B 19/10; A45B 19/06
See application file for complete search history.

(56) References Cited

U.S. PATENT DOCUMENTS 1,083,050 A * 12/1913 Bialozyt ..... A45B 19/10 135/31
1,083,123 A * 12/1913 Messinger ..... A45B 19/10 135/25.3
5,165,663 A * 11/1992 Wells ..... E04H 12/2269 52/165
5,235,998 A * 8/1993 Liu ..... A45B 19/10 135/31
6,328,046 B2 * 12/2001 Doreste ..... A45B 17/00 52/165
7,527,063 B1 * 5/2009 Chen ..... A45B 25/22 135/33.7
10,098,425 B2 * 10/2018 Haller ..... A45B 23/00
11,033,085 B1 * 6/2021 Chen ..... A45B 23/00
2015/0223578 A1 * 8/2015 Ma ..... A45B 19/06 135/31
2017/0152673 A1 * 6/2017 Fraser ..... E04H 15/28

FOREIGN PATENT DOCUMENTS

EP 2502517 A1 * 9/2012 ..... A45B 19/06

* cited by examiner

*Primary Examiner* — David R Dunn
*Assistant Examiner* — Danielle Jackson
(74) *Attorney, Agent, or Firm* — Wang Law Firm, Inc.

(57) ABSTRACT

A rod of an umbrella is a rod having a tail end and an extension rod having two ends; one end of the extension rod is detachably connected to the tail end of the rod; the rod is a hollow tube in which the extension rod is inserted, a limiting mechanism is located inside the rod for limiting insertion of the extension rod; the extension rod is made of rigid material or elastic material. When in use, the assembly can be completed by inserting the extension rod into the tail end of the rod, so that the rod becomes longer and is very easy to use. In the present invention, the rod is simple and reasonable in structure and easy and quick for operation and assembly, which can greatly increase the shading area, meet the functional requirements of the product, and reduce the packaging and transportation costs.

5 Claims, 9 Drawing Sheets

ROD OF AN UMBRELLA

TECHNICAL FIELD OF THE INVENTION

The present invention belongs to the technical field of umbrellas and relates to an umbrella, in particular to a rod of an umbrella.

BACKGROUND OF THE INVENTION

As an outdoor leisure appliance, umbrellas are widely used in squares, beaches, parks, courtyards and other leisure places, providing a comfortable space for people to enjoy the cool. For most of existing folding umbrellas, a canopy is unfolded and supported by several rods to achieve shading effect.

At present, rods of outdoor umbrellas have a fixed length that cannot be increased at will. However, in order to achieve better shading effect outdoors, it is necessary to increase the shading area, which requires longer rods. Moreover, the length of the rods often determines the length of umbrella packs, so too long rods will lead to a sharp increase in packaging and transportation costs.

Upon inquiry, a Chinese patent CN210726908U (patent No.201921502175.7), titled "Novel Automatic Folding Rod" comprises a first main rod and a tip, and a second main rod and a first fastener are hinged to the first main rod. According to the utility model, the automatic folding rod is provided with the first main rod, the second main rod, a third main rod, a fourth main rod and a fifth main rod, where a connecting wire is hinged between the second main rod and the first fastener, a second connecting wire is hinged between the first main rod and the second fastener, and a third connecting steel wire is hinged between the third main rod and the third fastener. The automatic folding rod is a four-fold rod which occupies less space for easy to carry when being folded, and allows a larger and lighter canopy when being unfolded. A pluggable rod is plugged into an inner chamber of the tip by pressing a slider and then into a first through hole, so that the pluggable rod is more firmly plugged into the tip, effectively avoiding the pluggable rod from dropping out of the tip in the process of folding. This umbrella has the rods that can be folded but are low in strength, so this umbrella cannot serve as a large outdoor umbrella but only as a portable small umbrella.

SUMMARY OF THE INVENTION

It is an object of the present invention to provide a rod of an umbrella with simple and reasonable structure and easy assembly, which can effectively extend the rod and reduce the packaging cost.

For achieving the object, the rod of an umbrella comprises a rod having a tail end and an extension rod having two ends; wherein, one end of the extension rod is detachably connected to the tail end of the rod.

Preferably, the rod is a hollow tube in which the extension rod is inserted, a limiting mechanism is located inside the rod for limiting insertion of the extension rod.

Preferably, the limiting mechanism comprises, without limitation, a joint disposed inside the rod, one end of the extension rod is inserted into the rod and is limited by resisting against on the joint; or the limiting mechanism comprises a fastener connected to the tail end of the rod, one end of the extension rod is inserted into the rod and is limited by resisting against the fastener; or the limiting mechanism comprises a recess located at the surface of the tail end of the rod, one end of the extension rod is inserted into the rod and is limited by resisting against on the inner sidewall of the rod corresponding to the recess.

Preferably, the joint located inside the tail end of the rod is hollow and has an open end and a closed end; the joint has a flange at the end of the joint, the flange has a closed end that blocks the tail end of the rod; one end of the extension rod is inserted into the joint and insertion of the extension rod is limited when the extension rod pushes against an inner sidewall of the closed end the joint.

Preferably, the fastener is a rivet, a screw, or a pin radially running through the tail end of the rod, and insertion of the end of the extension rod is limited by the fastener.

Preferably, the extension rod is made of rigid material or elastic material, and the elastic material comprises spring steel, glass fiber, carbon fiber, or plastic; and one end of the extension rod has an elastically deformable inserting section, and the other end of the extension rod is defined as a turning end.

Preferably, the inserting section is formed by overlapping a plurality of rod sections connected longitudinally, and the other end of the extension rod is formed by overlapping a plurality of rod sections connected vertically.

Finally, the limiting mechanism is not necessarily provided in the rod, the rod is a hollow tube for one end of the extension rod to insert inside; the extension rod has a diameter greater than an inner diameter of the hollow rod, one end of the extension rod has a small diameter section to insert into the hollow rod, and a circular step is formed between the small diameter section and the main body of the extension rod so as to make the extension rod be positioned with the tail end of the rod.

Compared with the prior art, the present invention has the advantages as follows. The extension rod is inserted into and connected to the rod, so that the extension rod can be removed easily. When in use, the assembly can be completed just by inserting the extension rod into the tail end of the rod, so that the rod becomes longer and is very easy to use. According to the present invention, the rod is simple and reasonable in structure and easy and quick for operation and assembly, which can greatly increase the shading area, meet the functional requirements of the product, and reduce the packaging and transportation costs.

DETAILED DESCRIPTION OF THE INVENTION

The present invention will be further described in detail by embodiments with reference to the accompanying drawings.

Embodiment 1

Figure 4:
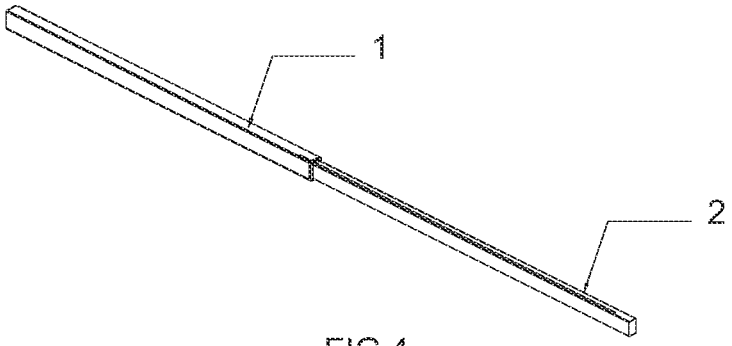
FIG. 4 is a perspective view of a rod according to Embodiment 1 of the present invention.
Figure 5:
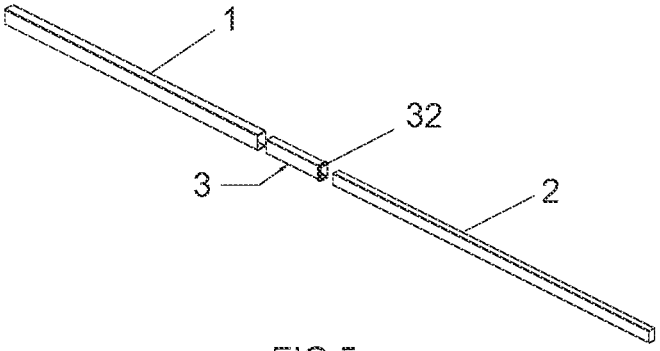
FIG. 5 is an exploded view of FIG. 4.
Figure 6:
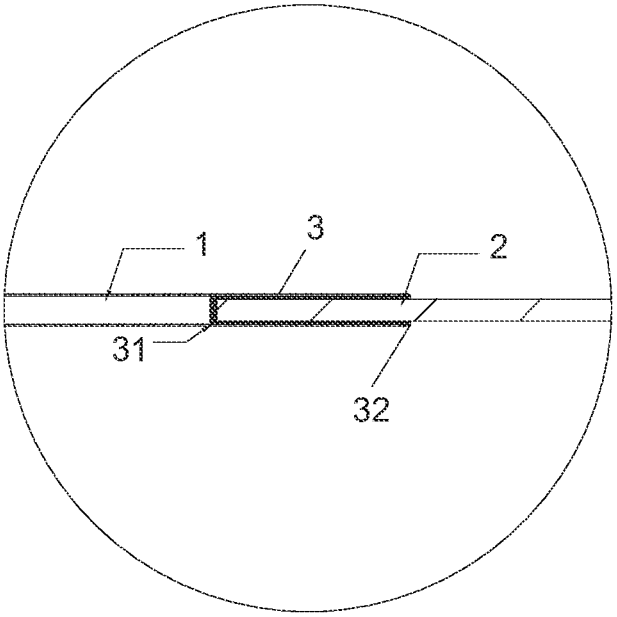
FIG. 6 is a partial sectional view of FIG. 4.

As shown in FIGS. 4 to 6, a rod of an umbrella comprises a rod 1 having a tail end and an extension rod 2 having two end; one end of the extension rod 2 is detachably connected to the tail end of the rod 1. The rod 1 is a hollow tube in which the extension rod 2 is inserted, a limiting mechanism is located inside the rod 1 for limiting insertion of the extension rod 2.

In this embodiment, the extension rod 2 is made of rigid material, and the limiting mechanism is that a joint 3 is disposed inside the rod 1, the joint 3 located inside the tail end of the rod 1 is hollow and has an open end and a closed end; the joint 3 has a flange 32 at the end of the joint 3, the flange 32 has a closed end that blocks the tail end of the rod 1; one end of the extension rod 2 is inserted into the joint 3 and insertion of the extension rod is limited when the extension rod pushes against an inner sidewall 31 of the closed end the joint 3.

When in use, the assembly can be completed just by inserting the extension rod 2 into the tail end of the rod 1, which is very easy and can also reduce the packaging cost.

Embodiment 2

Figure 7:
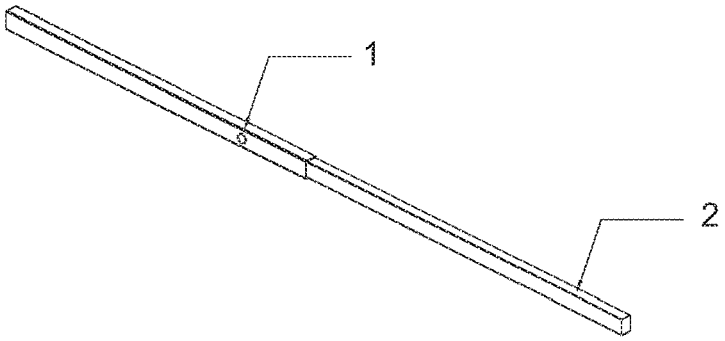
FIG. 7 is a perspective view of the rod according to Embodiment 2 of the present invention.
Figure 8:
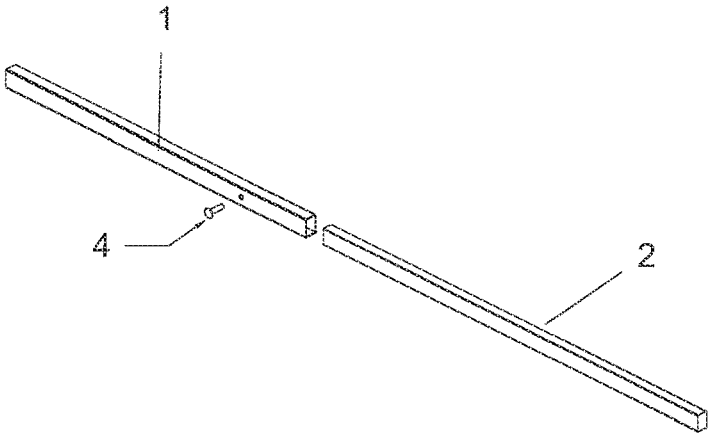
FIG. 8 is an exploded view of FIG. 7.
Figure 9:
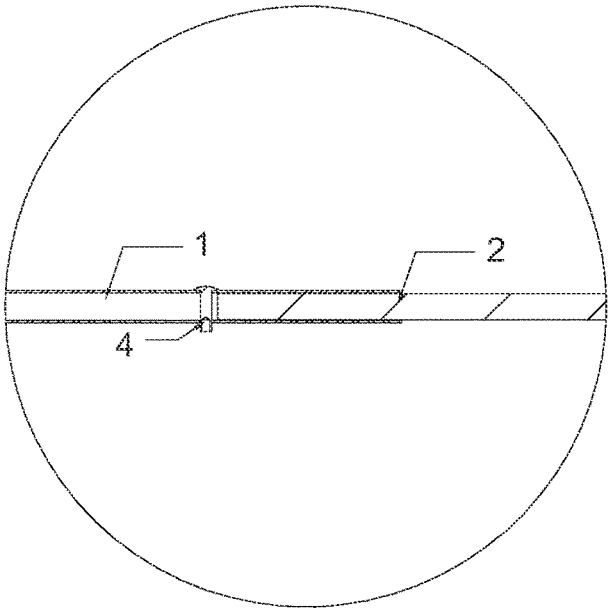
FIG. 9 is a partial sectional view of FIG. 7.

As shown in FIGS. 7 to 9, the difference from Embodiment 1 is that the limiting mechanism is a fastener such as a rivet 4. The rivet 4 runs through and is riveted to and the rod 1 transversely, and the extension rod 2 is made of rigid material, one end of the extension rod 2 is inserted into the rod 1 and is limited by the rivet 4. Of course, the fastener may also be replaced by a screw or a pin.

Embodiment 3

Figure 10:
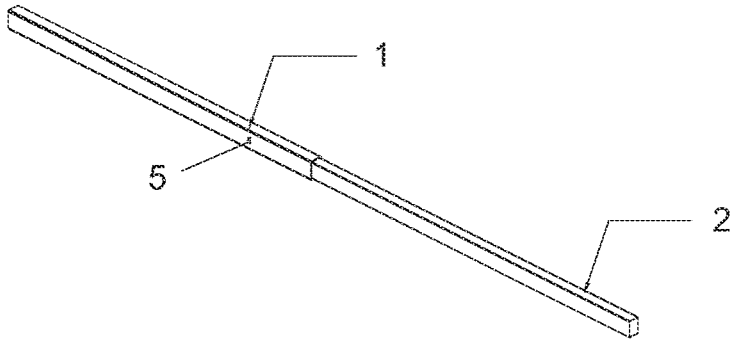
FIG. 10 is a perspective view of the rod according to Embodiment 3 of the present invention.
Figure 11:
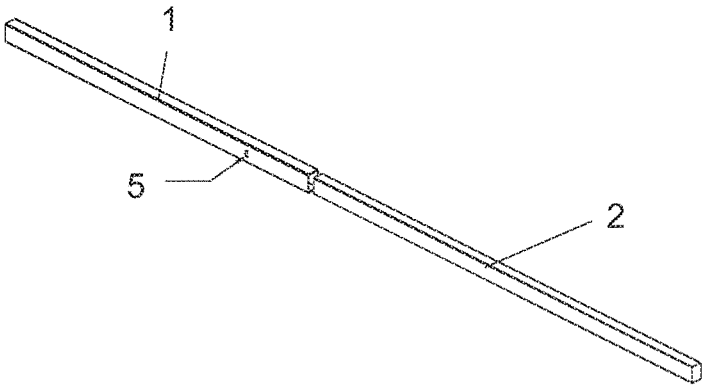
FIG. 11 is an exploded view of FIG. 10.
Figure 12:
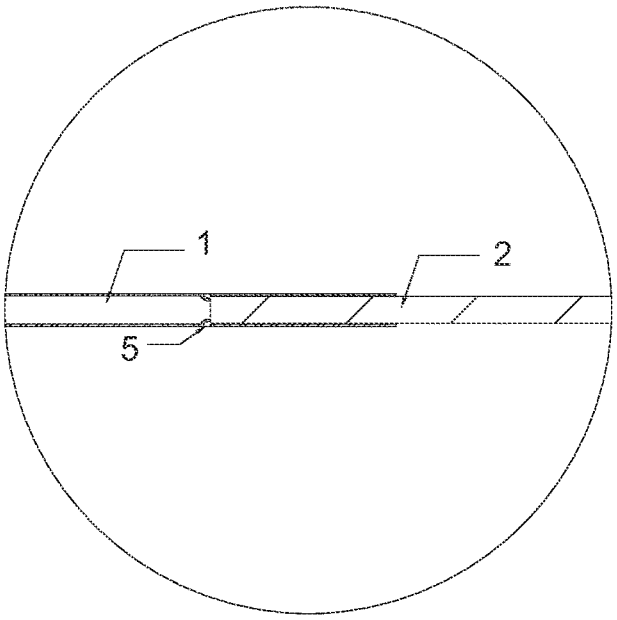
FIG. 12 is a partial sectional view of FIG. 10.

As shown in FIGS. 10 to 12, the difference from Embodiment 1 is that the limiting mechanism is a recess 5 punched at an end portion of the rod 1, similar to a depression machined by punching, and the extension rod 2 is made of rigid material, one end of the extension rod 2 is inserted into the rod 1 and is limited by the recess 5.

Embodiment 4

Figure 13:
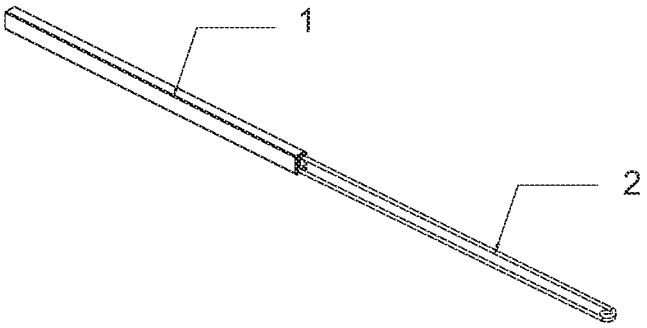
FIG. 13 is a perspective view of the rod according to Embodiment 4 of the present invention.
Figure 14:
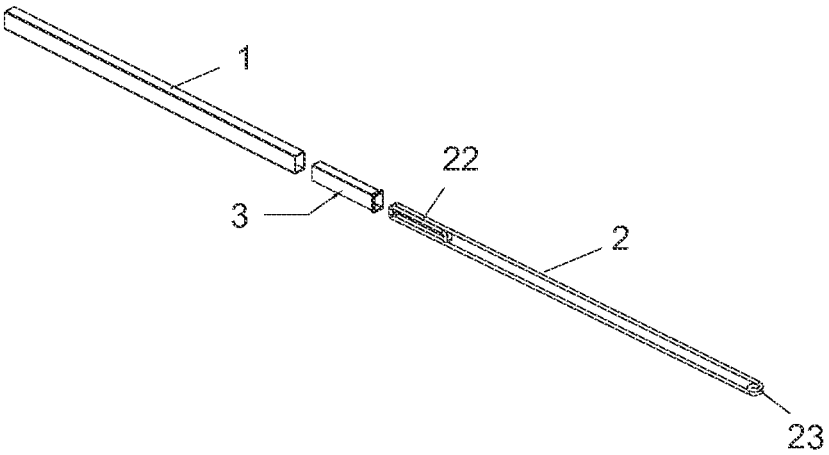
FIG. 14 is an exploded view of FIG. 13.
Figure 15:
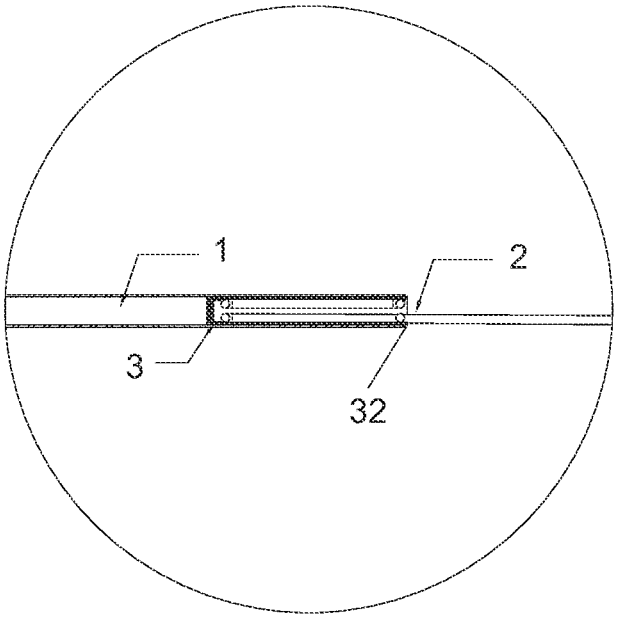
FIG. 15 is a partial sectional view of FIG. 13.
Figure 14A:
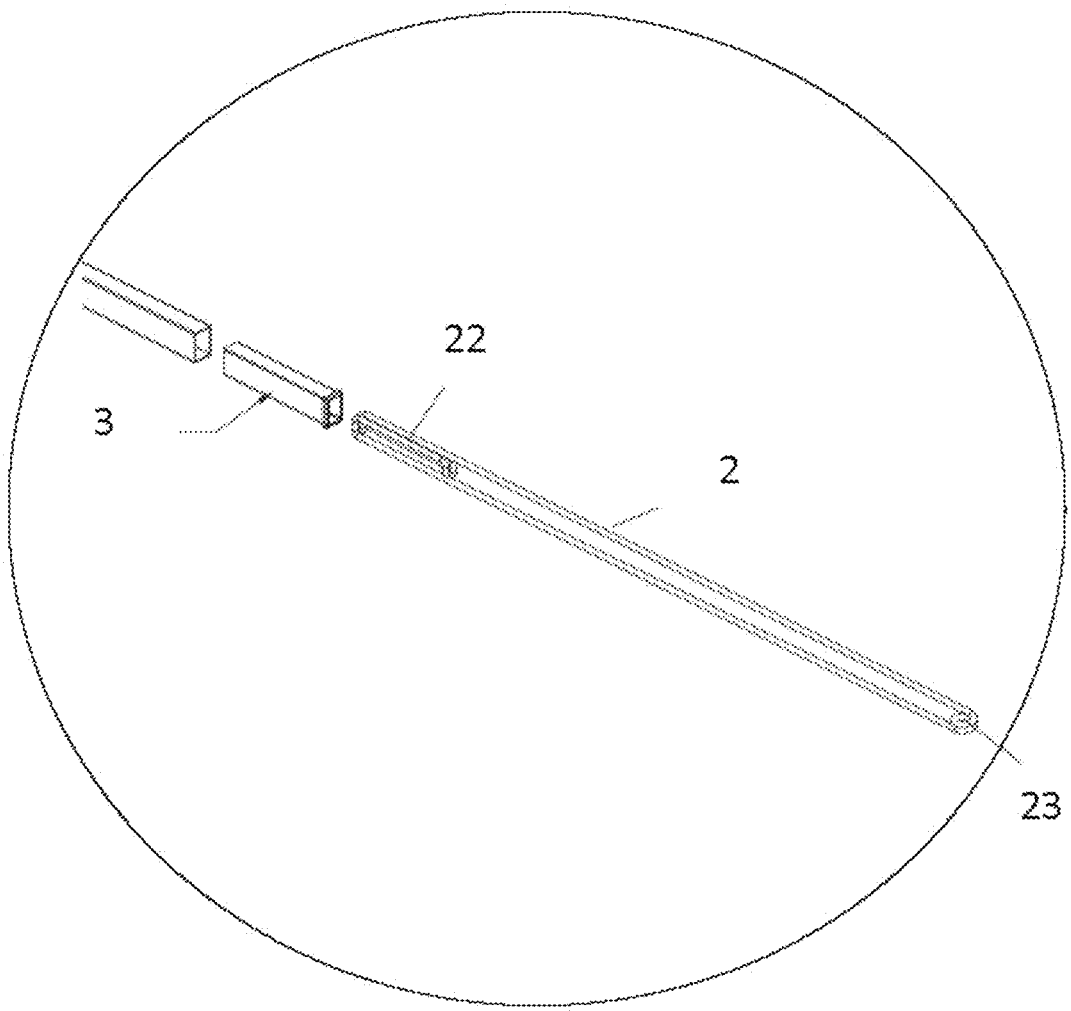
FIG. 14A is an enlarged view of a detail in FIG. 14.

As shown in FIGS. 13 to 15, the difference from Embodiment 1 is that the extension rod 2 is made of elastic material, and the elastic material comprises spring steel, glass fiber, carbon fiber, or plastic; and one end of the extension rod 2 has an elastically deformable inserting section 22, and the other end 23 of the extension rod 2 is defined as a turning end. The inserting section 22 is formed by overlapping a plurality of rod sections connected longitudinally, and the other end 23 of the extension rod 2 has a circular coil formed by overlapping a plurality of rod sections connected vertically, so that the connection strength of the extension rod 2 inserted into the joint 3 of the rod 1 can be properly adjusted, and one end of the extension rod 2 is inserted into the joint 3 and insertion of the extension rod is limited when the extension rod pushes against an inner sidewall 31 of the closed end the joint 3.

Embodiment 5

Figure 16:
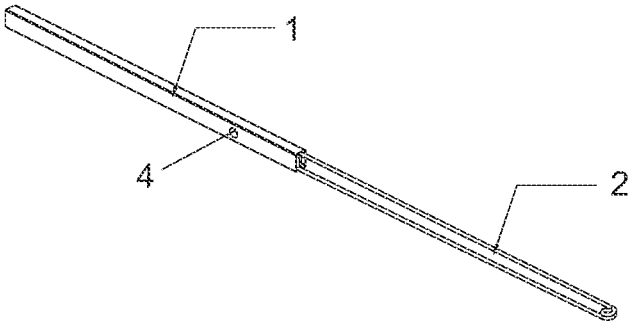
FIG. 16 is a perspective view of the rod according to Embodiment 5 of the present invention.
Figure 17:
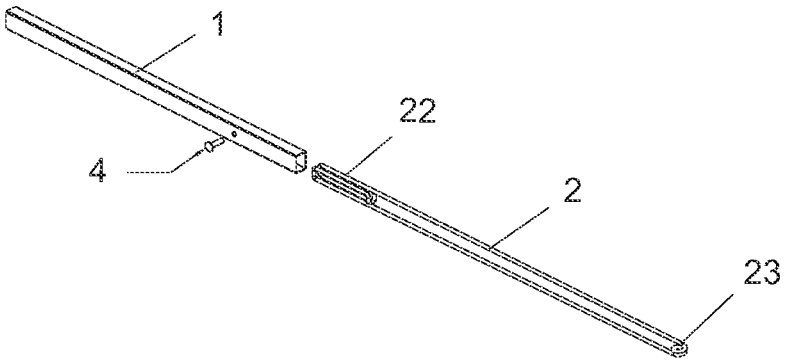
FIG. 17 is an exploded view of FIG. 16.
Figure 18:
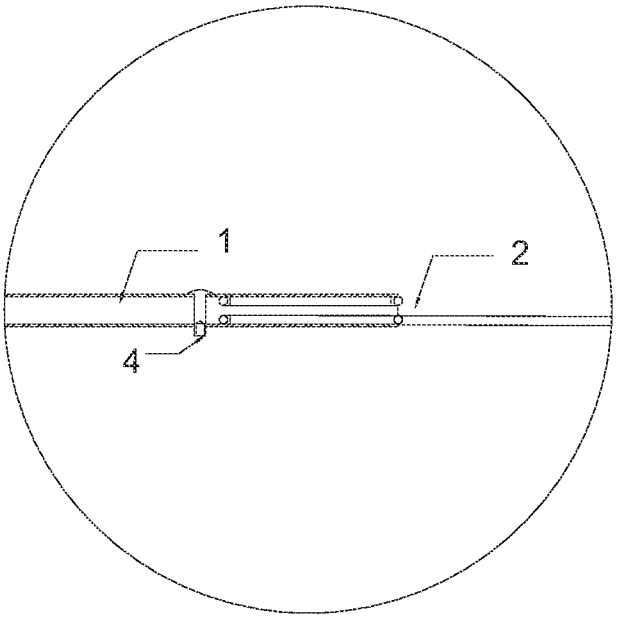
FIG. 18 is a partial sectional view of FIG. 16.

As shown in FIGS. 16 to 18, the difference from Embodiment 2 is that the extension rod 2 is made of elastic material, and the elastic material comprises spring steel, glass fiber, carbon fiber, or plastic; and one end of the extension rod 2 has an elastically deformable inserting section 22, and the other end 23 of the extension rod 2 is defined as a turning end. The inserting section 22 is formed by overlapping a plurality of rod sections connected longitudinally, and the other end 23 of the extension rod 2 has a circular coil formed by overlapping a plurality of rod sections connected vertically, and one end of the extension rod 2 is inserted into the tail end of the rod 1 and is limited by the rivet 4.

Embodiment 6

Figure 19:
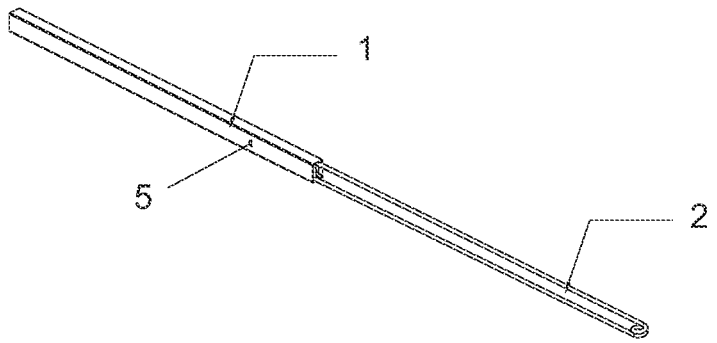
FIG. 19 is a perspective view of the rod according to Embodiment 6 of the present invention.
Figure 20:
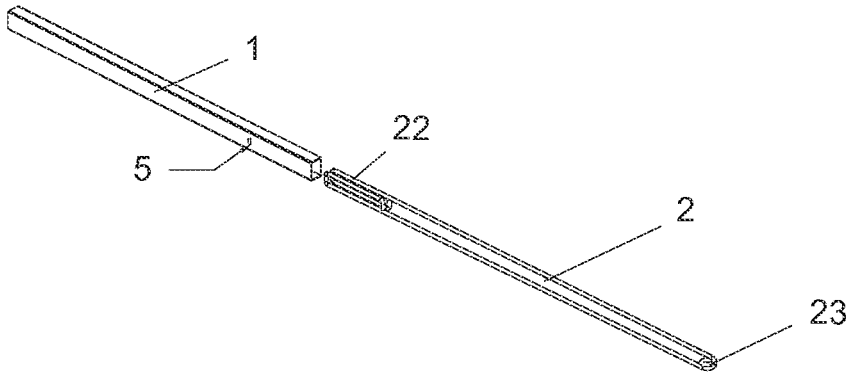
FIG. 20 is an exploded view of FIG. 19.
Figure 21:
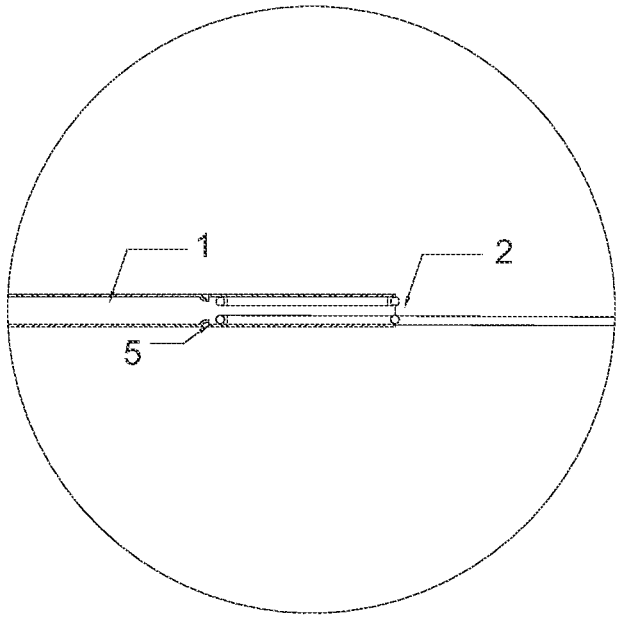
FIG. 21 is a partial sectional view of FIG. 19.

As shown in FIGS. 19 to 21, the difference from Embodiment 3 is that the extension rod 2 is made of elastic material, and the elastic material comprises spring steel, glass fiber, carbon fiber, or plastic; and one end of the extension rod 2 has an elastically deformable inserting section 22, and the other end 23 of the extension rod 2 is defined as a turning end. The inserting section 22 is formed by overlapping a plurality of rod sections connected longitudinally, and the other end 23 of the extension rod 2 has a circular coil formed by overlapping a plurality of rod sections connected vertically, and one end of the extension rod 2 is inserted into the rod 1 and is limited by the recess 5.

Embodiment 7

Figure 22:
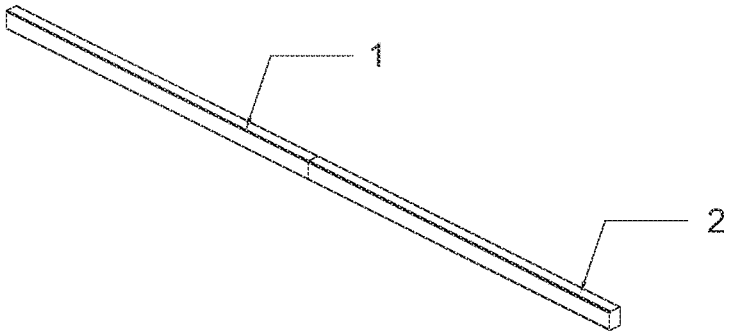
FIG. 22 is a perspective view of the rod according to Embodiment 7 of the present invention.
Figure 23:
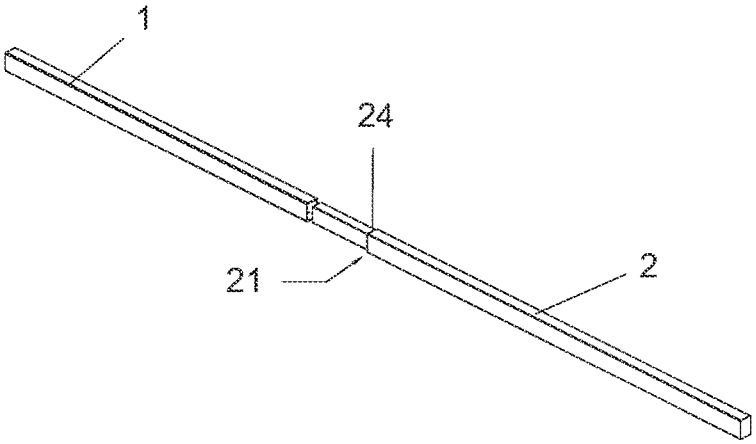
FIG. 23 is an exploded view of FIG. 22.
Figure 24:
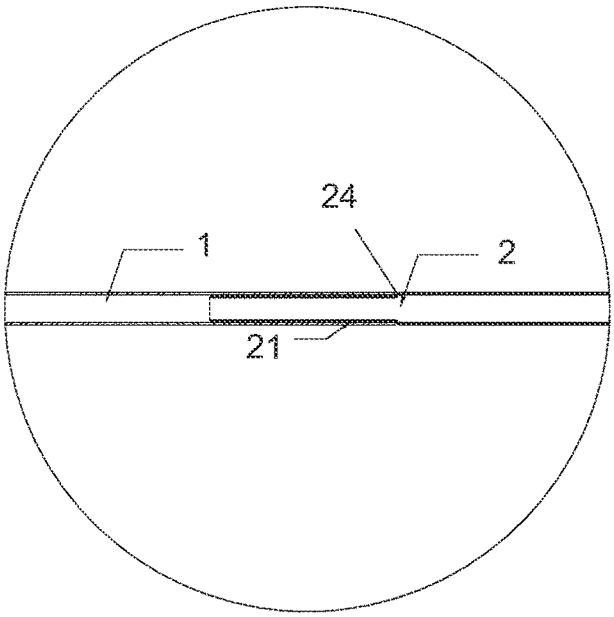
FIG. 24 is a partial sectional view of FIG. 22.

As shown in FIGS. 22 to 24, the difference from the Embodiment 1 is that the limiting mechanism is not necessarily disposed in the rod 1, and the extension rod 2 is made of rigid material and the rod 1 is a hollow tube for one end of the extension rod 2 to insert inside; the extension rod 2 has a diameter greater than an inner diameter of the hollow rod 1, one end of the extension rod 2 has a small diameter section 21 to insert into the hollow rod 1, and a circular step 24 is formed between the small diameter section 21 and the main body of the extension rod 2 so as to make the extension rod 2 be positioned with the tail end of the rod 1.

Figure 1:
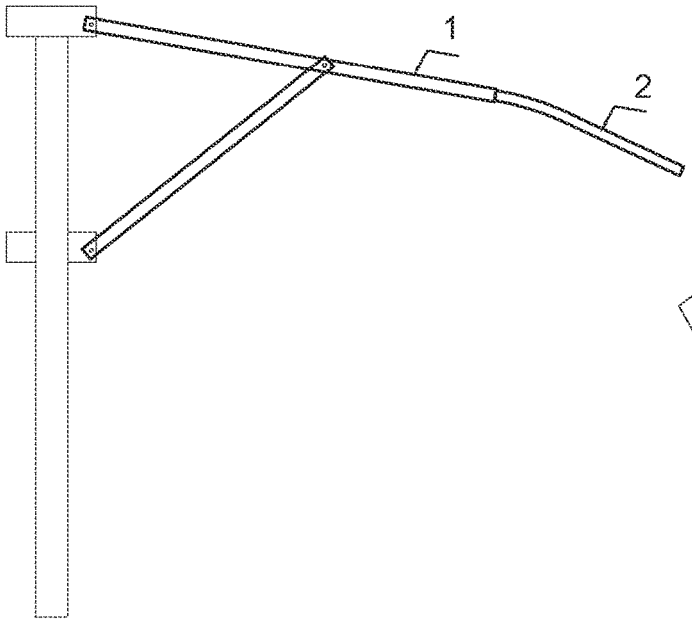
FIG. 1 is a front view of the a rod according to Embodiment 4, 5, and 6 of the present invention.
Figure 2:
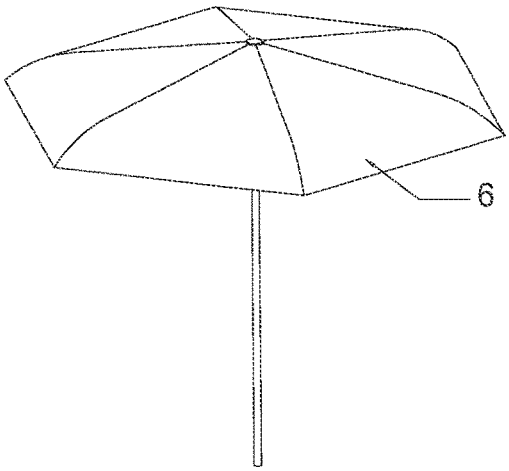
FIG. 2 is a perspective view of an umbrella with the rod of Embodiments 4, 5, and 6 of the present invention.
Figure 3:
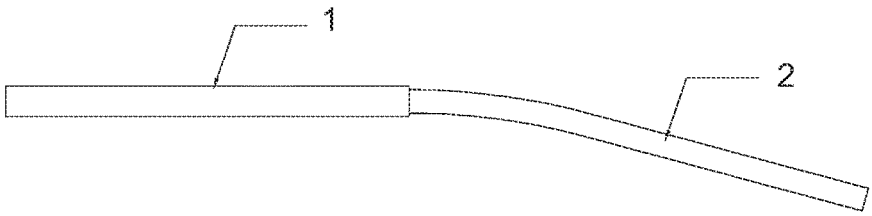
FIG. 3 is a front view of the rod with an elastic extension rod bent under the action of a canopy according to Embodiments 4, 5 and 6 of the present invention.

When the extension rod 2 is made of elastic material, in Embodiments 4, 5 and 6, the elastic extension rod 2 can be forced to bend under the tension of a canopy 6, as shown in FIG. 1 and FIG. 2, thus forming a special shape of umbrella, as shown in FIG. 2, which is more aesthetic.

Those described above are merely preferred embodiments of the present invention. It should be noted that a number of improvements and refinements may be made by those of ordinary skill in the art without departing from the principles of the present invention, and such improvements and refinements shall also fall into the protection scope of the present invention.

The invention claimed is:

1. A rod of an umbrella, comprising:

a rod having a tail end; and an extension rod having a main body, a first end, an opposite second end, and the second end having a circular coil;

wherein, the extension rod is made of rigid material or elastic material;

an inserting section is formed by the first end of the extension rod;

the inserting section of the extension rod is detachably connected to the tail end of the rod, the circular coil on the second end forms a turning end;

the elastic material comprises spring steel, glass fiber, carbon fiber, or plastic.

2. The rod of claim 1, wherein the rod is a hollow tube in which the extension rod is inserted, a limiting mechanism is located inside the rod for limiting insertion depth of the extension rod.

3. The rod of claim 2, wherein the limiting mechanism comprises a joint disposed inside the rod, the inserting section of the extension rod is inserted into the rod and is limited by resisting against the joint;

or the limiting mechanism comprises a fastener connected to the tail end of the rod, the inserting section of the extension rod is inserted into the rod and is limited by resisting against the fastener;

or the limiting mechanism comprises a recess located at a surface of the tail end of the rod, the inserting section of the extension rod is inserted into the rod and is limited by resisting against an inner sidewall of the rod corresponding to the recess.

4. The rod of claim 3, wherein the joint located inside the tail end of the rod is hollow and has an open end and a closed end;

the closed end of the joint inserts inside the rod from the tail end of the rod, and the joint has a flange at the open end of the joint which rests against the tail end of the rod so that the flange of the joint is positioned at the tail end of the rod;

the inserting section of the extension rod is inserted into the joint and insertion of the extension rod is limited when the extension rod pushes against an inner sidewall of the closed end of the joint.

5. The rod of claim 3, wherein the fastener is a rivet, a screw, or a pin radially running through the tail end of the rod, and insertion of the inserting section of the extension rod is limited by the fastener.

* * * * *